US009315027B1

(12) United States Patent
Kalb et al.

(10) Patent No.: US 9,315,027 B1
(45) Date of Patent: Apr. 19, 2016

(54) SCALABLE PRINTHEAD MAINTENANCE CART HAVING MAINTENANCE MODULES

(71) Applicant: Xerox Corporation, Norwalk, CT (US)

(72) Inventors: Richard A. Kalb, Rochester, NY (US); Glenn D. Batchelor, Fairport, NY (US); Ali R. Dergham, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/708,557

(22) Filed: May 11, 2015

(51) Int. Cl.
*B41J 2/165* (2006.01)
*B41J 2/155* (2006.01)
*B41J 25/34* (2006.01)

(52) U.S. Cl.
CPC ..... *B41J 2/16517* (2013.01); *B41J 2/155* (2013.01); *B41J 2/16547* (2013.01); *B41J 25/34* (2013.01); *B41J 2202/20* (2013.01)

(58) Field of Classification Search
CPC . B41J 2/16588; B41J 2/165; B41J 2002/1655
See application file for complete search history.

(56) References Cited

U.S. PATENT DOCUMENTS

| | | | | |
|---|---|---|---|---|
| 7,748,823 | B2 | 7/2010 | Hung | |
| 2008/0309702 | A1* | 12/2008 | Takahashi | B41J 2/16511 347/19 |
| 2009/0073221 | A1* | 3/2009 | Yoda | B41J 2/16511 347/33 |
| 2010/0245467 | A1* | 9/2010 | Phillips | B41J 2/16544 347/33 |
| 2011/0234696 | A1* | 9/2011 | Inoue | B41J 2/16588 347/33 |
| 2014/0125749 | A1* | 5/2014 | Spence | B41J 2/215 347/104 |

* cited by examiner

*Primary Examiner* — Shelby Fidler
(74) *Attorney, Agent, or Firm* — Maginot Moore & Beck LLP

(57) ABSTRACT

A maintenance cart is configured so the maintenance units within the cart can be selectively moved to correspond to a scalable printhead array. The maintenance cart includes a body configured to selectively move along a path to the printhead array, the body having a recess; and a plurality of cleaning modules mounted within the recess, the plurality of cleaning modules being adjustably arranged within the recess to correspond to a plurality of printheads of the printhead array to enable each cleaning module in the plurality of cleaning modules to align with a corresponding printhead of the printhead array in response to the body being moved to the printhead array.

18 Claims, 9 Drawing Sheets

SCALABLE PRINTHEAD MAINTENANCE CART HAVING MAINTENANCE MODULES

TECHNICAL FIELD

The apparatus disclosed in this document relates to inkjet printers and, more particularly, to maintenance of scalable inkjet printhead arrays.

BACKGROUND

Inkjet printing is a process of producing an image on a substrate, such as a sheet of paper. Inkjet printing is an additive process in which one or more printheads eject drops of ink onto the substrate to form the image on the substrate. The printheads are operated with reference to digital image data that represents the image to be printed. Printing a multicolored image generally requires at least one printhead for each color. Additionally, printing high resolution images often requires multiple printheads of the same color that are interlaced to provide the increased resolution. Accordingly, many inkjet printing systems comprise arrays of several printheads arranged in rows and columns.

FIG. 9 shows a prior art architecture for a scalable printhead array 900. The printhead array 900 includes a plurality of printhead assemblies 904. The printhead array 900 is configured to include a variable number of printhead assemblies 904 arranged into rows and columns in a variety of possible arrangements. As shown, the printhead array 900 is scalable up to 50" in width and includes up to fourteen printhead assemblies 904. Each printhead assembly 904 is configured to receive a printhead module 908 and to mount to frame 912 of the printhead array 900. FIG. 10 shows a more detailed view of one of the printhead assemblies 904 with a printhead module 908.

To ensure optimal performance of an inkjet printhead, the printheads must be well-maintained. Typically maintenance operations include purging, capping, and wiping. Prior art mechanisms for printhead maintenance are not easily adapted for scalable printhead arrays. Being able to configure a printhead maintenance system so it is easily scalable for use with a scalable printhead array would be beneficial.

SUMMARY

A maintenance cart for maintaining a scalable printhead array has been developed. The maintenance cart includes a body configured to selectively move along a path to the printhead array, the body having a recess; and a plurality of cleaning modules mounted within the recess, the plurality of cleaning modules being adjustably arranged within the recess to correspond to a plurality of printheads of the printhead array to enable each cleaning module in the plurality of cleaning modules to align with a corresponding printhead of the printhead array in response to the body being moved to the printhead array.

A printer includes a printhead array have a plurality of printheads; a track defining a path leading to and from the printhead array; and a maintenance cart configured to selectively move along the track to and from the printhead array to perform maintenance operations on the printhead array, the maintenance cart comprising: a body having a recess; and a plurality of cleaning modules mounted within the recess, the plurality of cleaning modules being adjustably arranged within the recess to correspond to the plurality of printheads of the printhead array to enable each cleaning module in the plurality of cleaning modules to align with a corresponding printhead of the printhead array in response to the body being moved to the printhead array.

BRIEF DESCRIPTION OF THE DRAWINGS

The foregoing aspects and other features of printhead maintenance systems are explained in the following description, taken in connection with the accompanying drawings.

DETAILED DESCRIPTION

Figure 1:
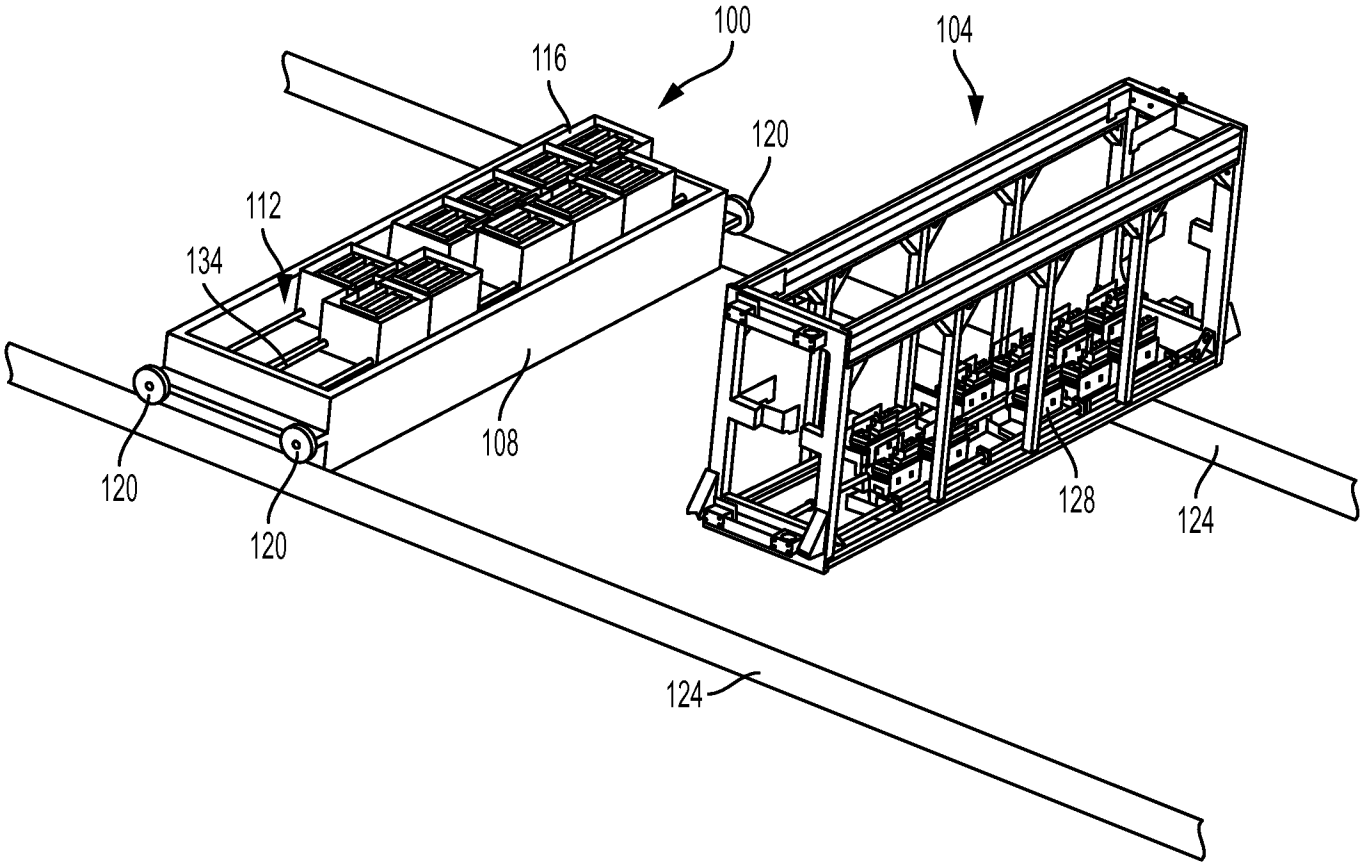
FIG. 1 shows a perspective view maintenance cart for maintaining a scalable printhead array and a scalable printhead array.

For a general understanding of the environment for the maintenance cart disclosed herein as well as the details for the maintenance cart, reference is made to the drawings. In the drawings, like reference numerals designate like elements.

FIG. 1 shows a printer having maintenance cart 100 for maintaining a scalable printhead array 104, which is similar to the printhead array 900. The maintenance cart 100 has a cart body 108. The cart body 108 has a wall that forms a continuous perimeter having a recess 112 within the perimeter. A plurality of maintenance modules 116 is disposed within the recess 112. A set of wheels 120 are mounted to the cart body 108 and configured to engage with a track, such as a pair of rails 124, to enable the maintenance cart 100 to move along the rails 124 to and from the printhead array 104. In one embodiment, the rails 124 are also used by a media cart configured to convey a substrate to and from the printhead array 104 for printing operations.

The printhead array 104 has a configuration of printhead assemblies 128, similar to the printhead assemblies 904. In the embodiment of FIG. 1, the printhead assemblies 128 are arranged in two rows. The printhead array 104 has a variable number of printhead assemblies 128 arranged in each of the two rows. The maintenance modules 116 of the maintenance cart 100 are arranged within the recess 112 in a configuration that corresponds to the configuration of printhead assemblies 128 in the printhead array 104 such that when the maintenance cart 100 moves beneath the printhead array the maintenance modules 116 align with printhead assemblies 128 in a one-to-one correspondence. In the embodiment shown in FIG. 1, the maintenance cart 100 has variable number of maintenance modules 116 arranged in two rows to match the two rows of printhead assemblies 128 in the printhead array 104.

In one embodiment, the maintenance cart 100 includes shafts 134 that extend across the recess 112. The maintenance modules 116 are adjustably arranged along the shafts 134 in a configuration that matches the configuration of the printhead assemblies 128 in the printhead array 104. The maintenance modules 116 are configured to slide along the shafts 134 and selectively fixed to the shafts to enable their configuration to be easily adjusted to match the configuration of the printhead assemblies 128 in the printhead array 104. Accordingly, if the configuration of the printhead assemblies 128 is modified, the maintenance modules in the current configuration are released from the shafts, moved to a location that corresponds to one of the printheads the printhead assemblies, and fixed at those locations to match the new configuration of printhead assemblies 128. In this way, the maintenance cart 100 has the same scalability and customizability as the printhead array 104. As used in this document, the term "adjustably arranged" refers to the maintenance modules being configured for selective movement to correspond to different configurations of printheads in printhead assemblies.

Figure 2:
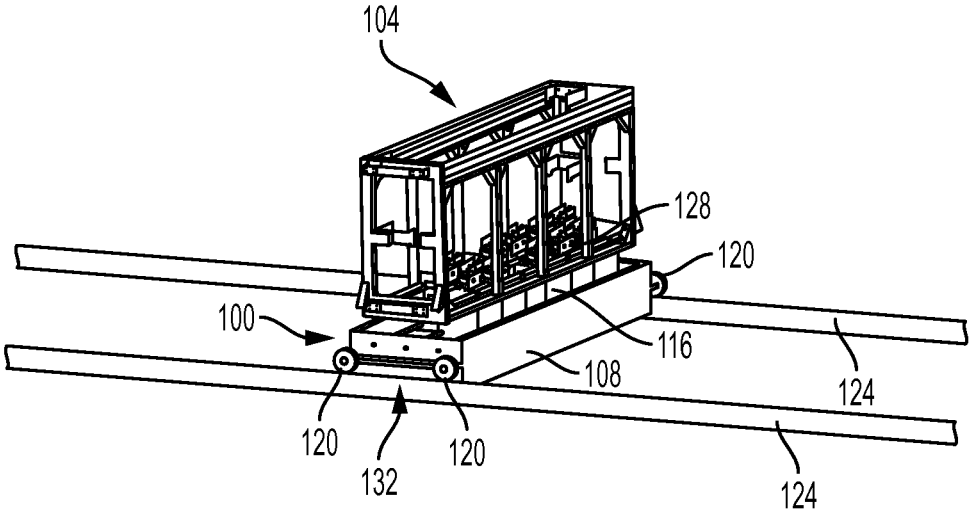
FIG. 2 shows a perspective view of the maintenance cart at an operating position beneath the scalable printhead array.
Figure 3:
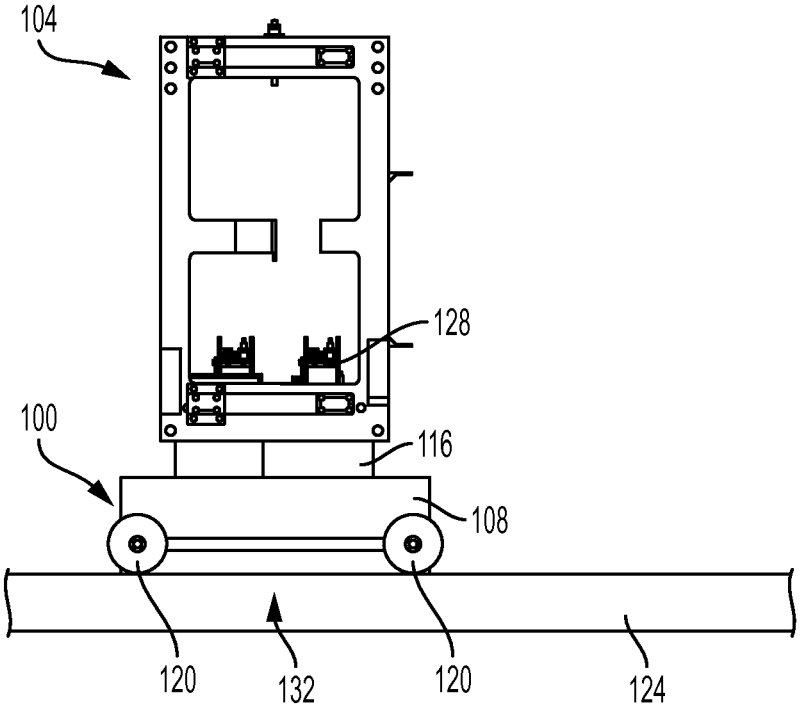
FIG. 3 shows a side view of the maintenance cart at an operating position beneath the scalable printhead array.

To perform maintenance operations on the printhead array 104, the maintenance cart 100 moves along the rails 124 to an operating position 132 located beneath the printhead array 104 and between the printhead array 104 and the rails 124. FIG. 2 and FIG. 3 show the maintenance cart 100 positioned at the operating position 132 beneath the printhead array 104. Once positioned at the operating position 132, the maintenance modules 116 of the maintenance cart 100 perform maintenance operations on the printheads of the printhead assemblies 128 of the printhead array 104. In some embodiments, the maintenance operations include one or more of: purging ink from the printheads, wiping debris from a surface of the printheads, and capping the printheads with a seal. After the maintenance modules 116 perform the maintenance operations, the maintenance cart 100 moves along the rails 124 away from the printhead array 104.

Figure 4:
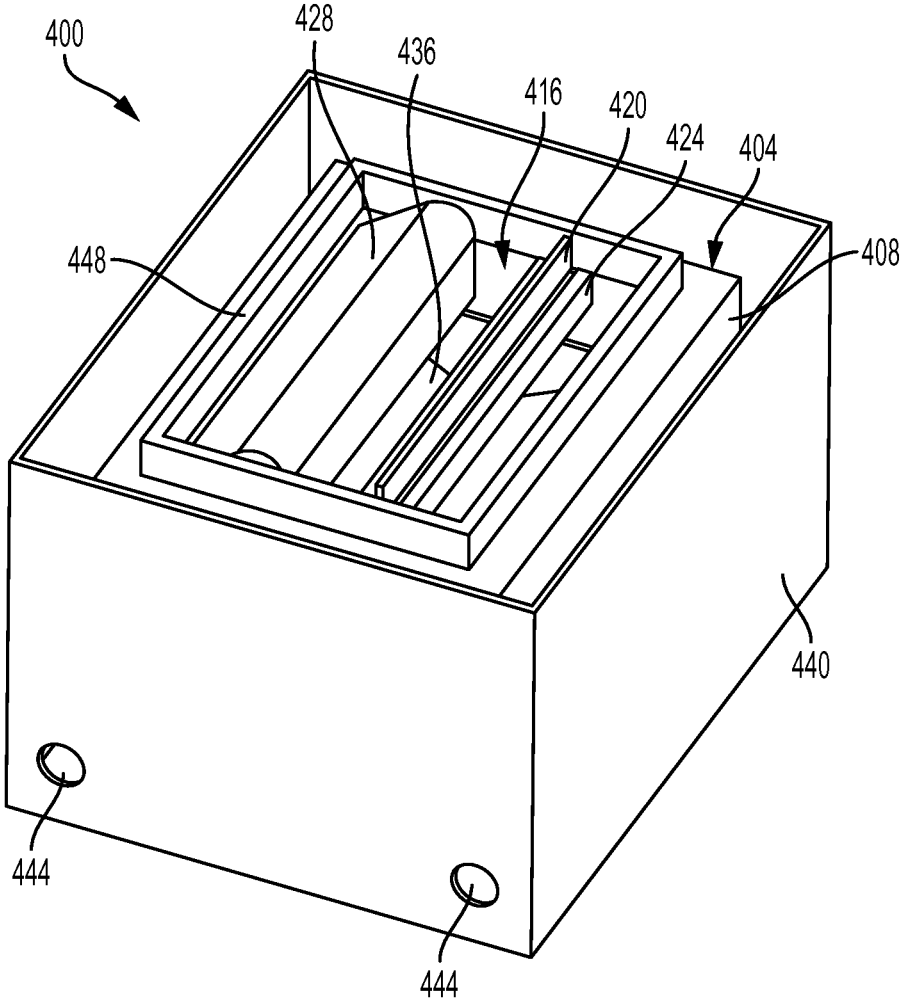
FIG. 4 shows a perspective view of a maintenance module.

FIG. 4 shows a maintenance module 400. The maintenance module 400 comprises a body 404. In one embodiment, the body 404 has an upper portion 408 and a lower portion 412 (shown in FIG. 5). The upper portion 408 has a continuous perimeter that defines a recess 416. A wiper blade 420 is mounted within the recess 416 and configured to extend from the recess 416 in a direction pointing away from the lower portion 412 of the body 404. In one embodiment, the wiper blade 420 is mounted with a mount 424. The wiper blade 420 is configured to be detachably connected to mount 424 to enable easy replacement of the wiper blade 420. A wiping cloth 428 is similarly mounted within the recess 416. In one embodiment, the wiping cloth 428 is a flexible material entrained in a closed loop around rollers 432 (shown in FIG. 6). The flexible material in some embodiments is porous to facilitate the absorption of material on the face of a printhead by the flexible material. The rollers 432 are configured to rotate the wiping cloth 428 about the closed loop. A tray 436 is mounted within the recess 416 to receive debris dislodged by the wiper blade 420 and the wiping cloth 428. In some embodiments, the maintenance module 400 includes an enclosure 440. The body 404 is disposed within the enclosure 440. In one embodiment, the enclosure 440 is configured to mount onto the shafts 134 via holes 444.

Figure 5:
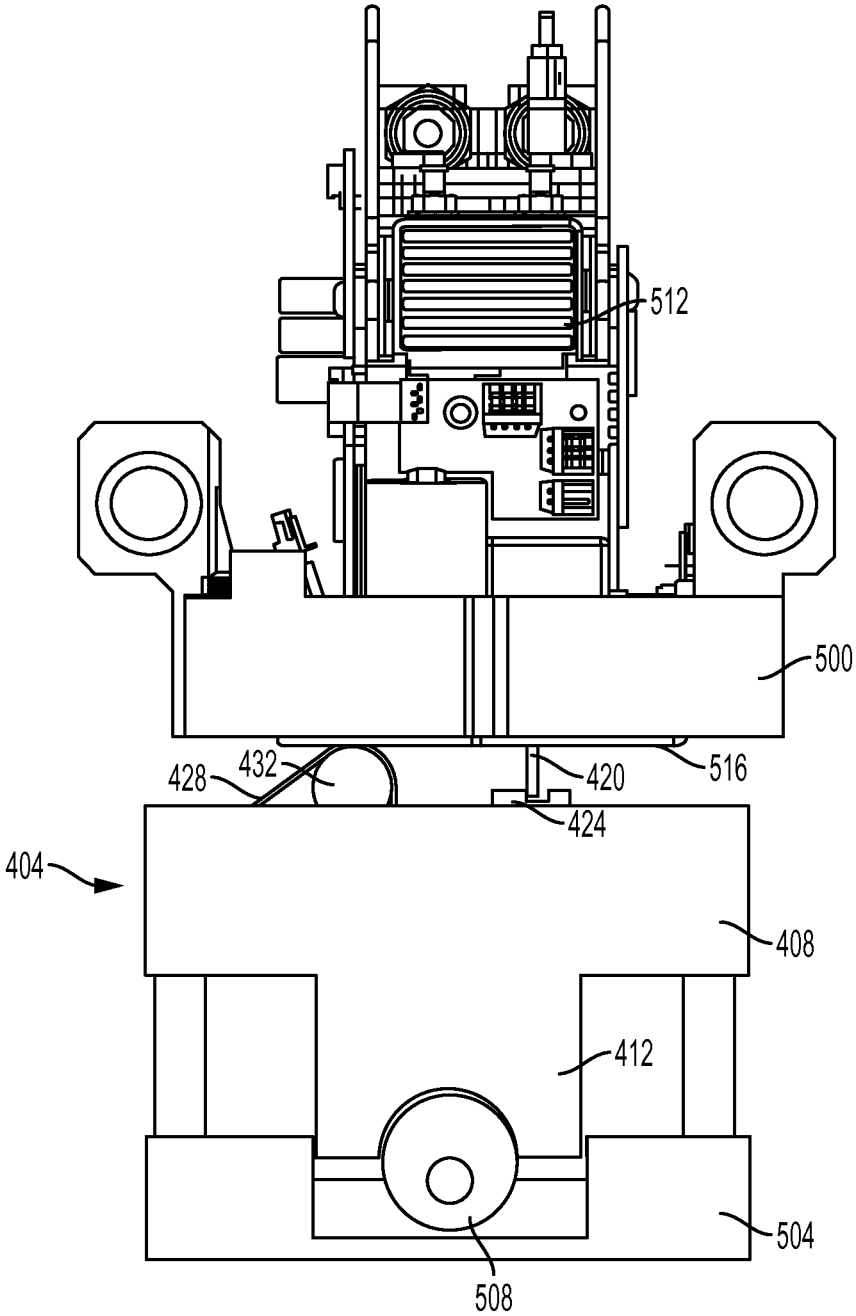
FIG. 5 shows a side view of a maintenance module without an enclosure aligned with a corresponding printhead assembly of the scalable printhead array.

FIG. 5 shows the maintenance module 400 aligned with a printhead assembly 500 of printhead array 104. In FIG. 5, the maintenance module 400 is shown without the enclosure 440. In one embodiment, the maintenance module 400 includes a base 504. An actuator, such as the cam 508, is mounted to the base 504. The cam 508 is configured to interface with the body 404. Particularly, the cam 508 is configured to rotate and move the body 404 towards the printhead assembly 500. In one embodiment, base 504 is mounted within the enclosure 440 and is fixed in place with respect to the enclosure 440, while the body 404 is configured to move freely with respect to the enclosure 440.

Figure 6:
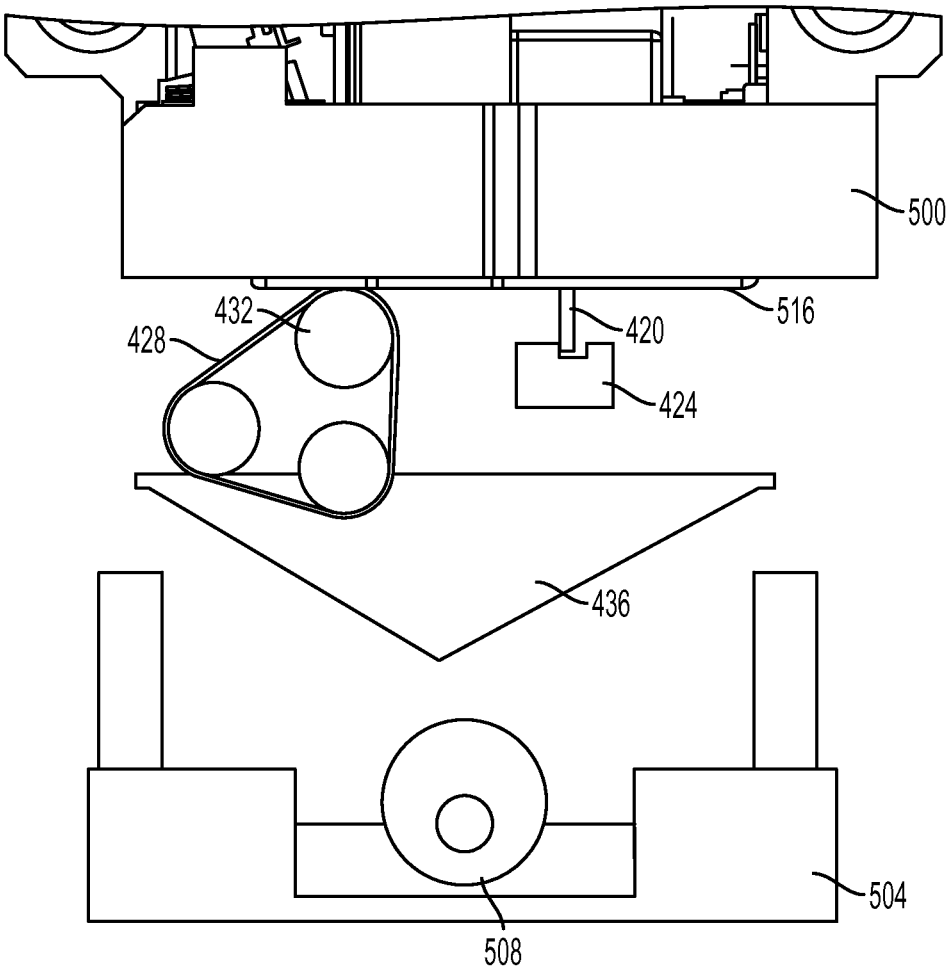
FIG. 6 shows a side view of a maintenance module without an enclosure and body aligned with a corresponding printhead assembly of the scalable printhead array.

When maintenance operations are performed, the maintenance module 400 is aligned with a printhead 512 of the printhead assembly 500. Once the maintenance module 400 is aligned with the printhead 512, a controller commands the cam 508 to rotate and move the body 404 toward the printhead 512 to bring the wiper blade 420 and the wiping cloth 428 into contact with a surface 516 of the printhead 512. In one embodiment, the maintenance cart 100 moves along the rails 124 relative to the printhead 512 so that the wiper blade 420 and then the wiping cloth 428 wipe against the surface 516 to remove debris. As shown in FIG. 6, the tray 436 is positioned beneath the wiper blade 420 and the wiping cloth 428 to catch any debris that falls from the surface 512. In one embodiment, maintenance operations are only performed on printheads that were used since a prior maintenance operation.

Figure 7:
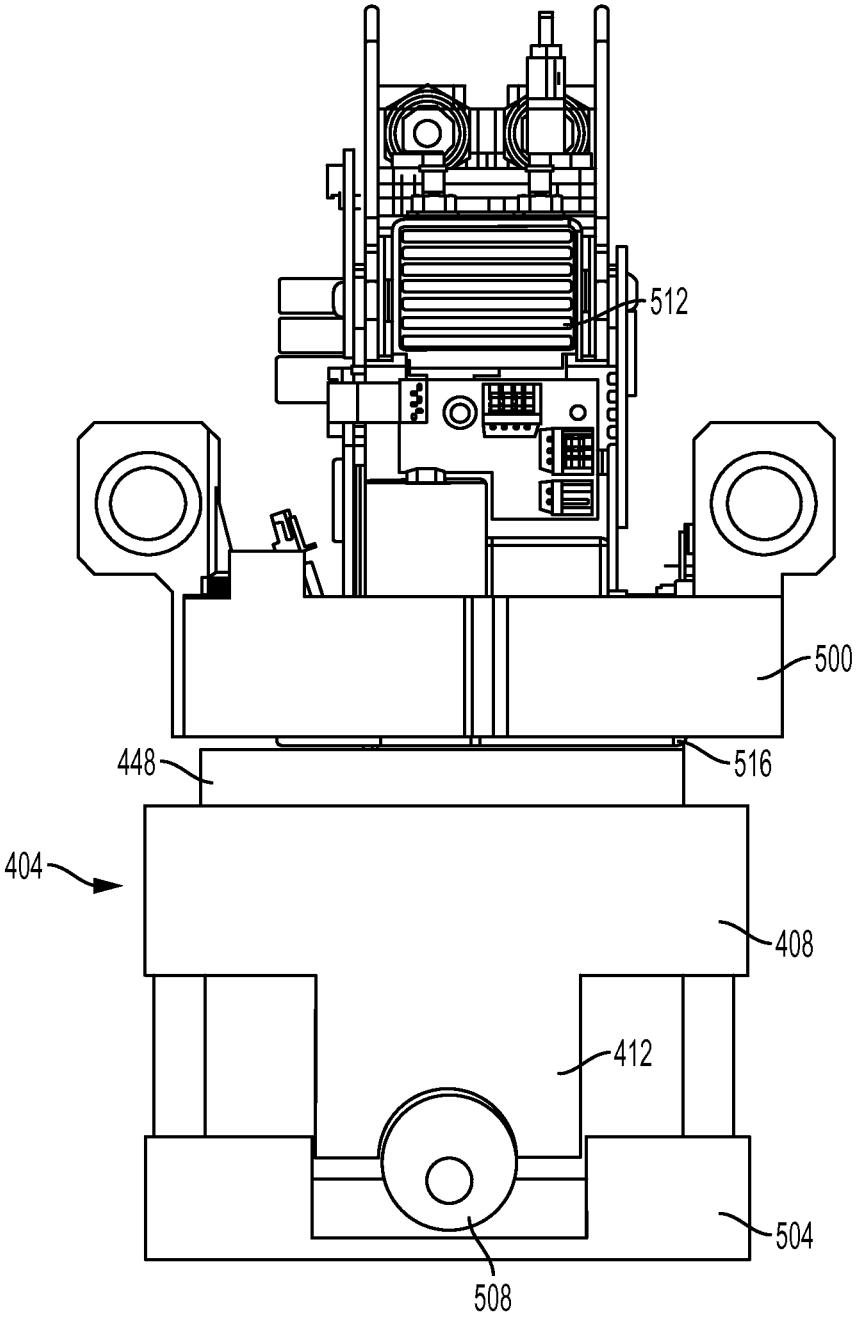
FIG. 7 shows a side view of a maintenance module without an enclosure with a seal pressed against a surface of the printhead of the printhead assembly.
Figure 8:
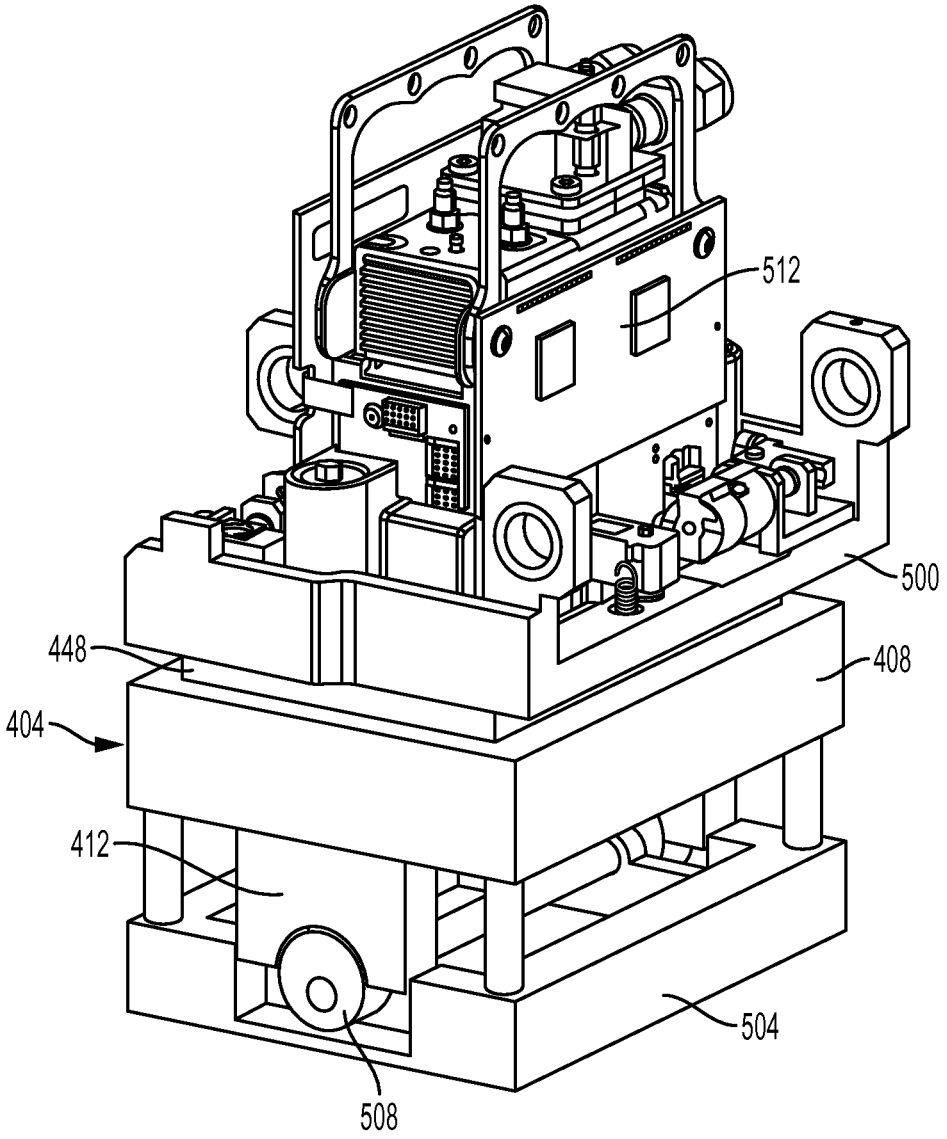
FIG. 8 shows a perspective view of a maintenance module without an enclosure with a seal pressed against a surface of the printhead of the printhead assembly.
Figure 9:
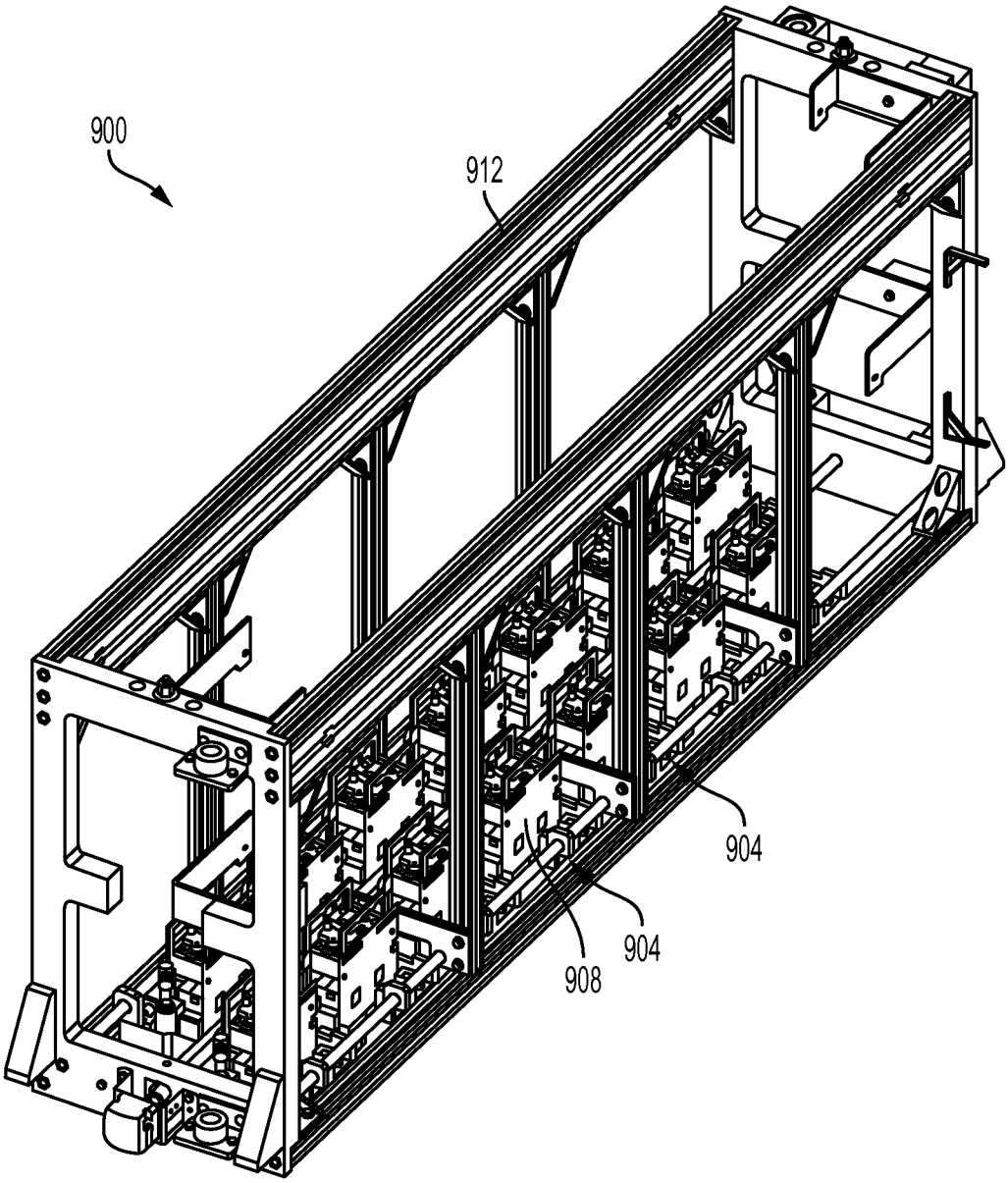
FIG. 9 PRIOR ART
FIG. 9 shows a prior art scalable printhead array.
Figure 10:
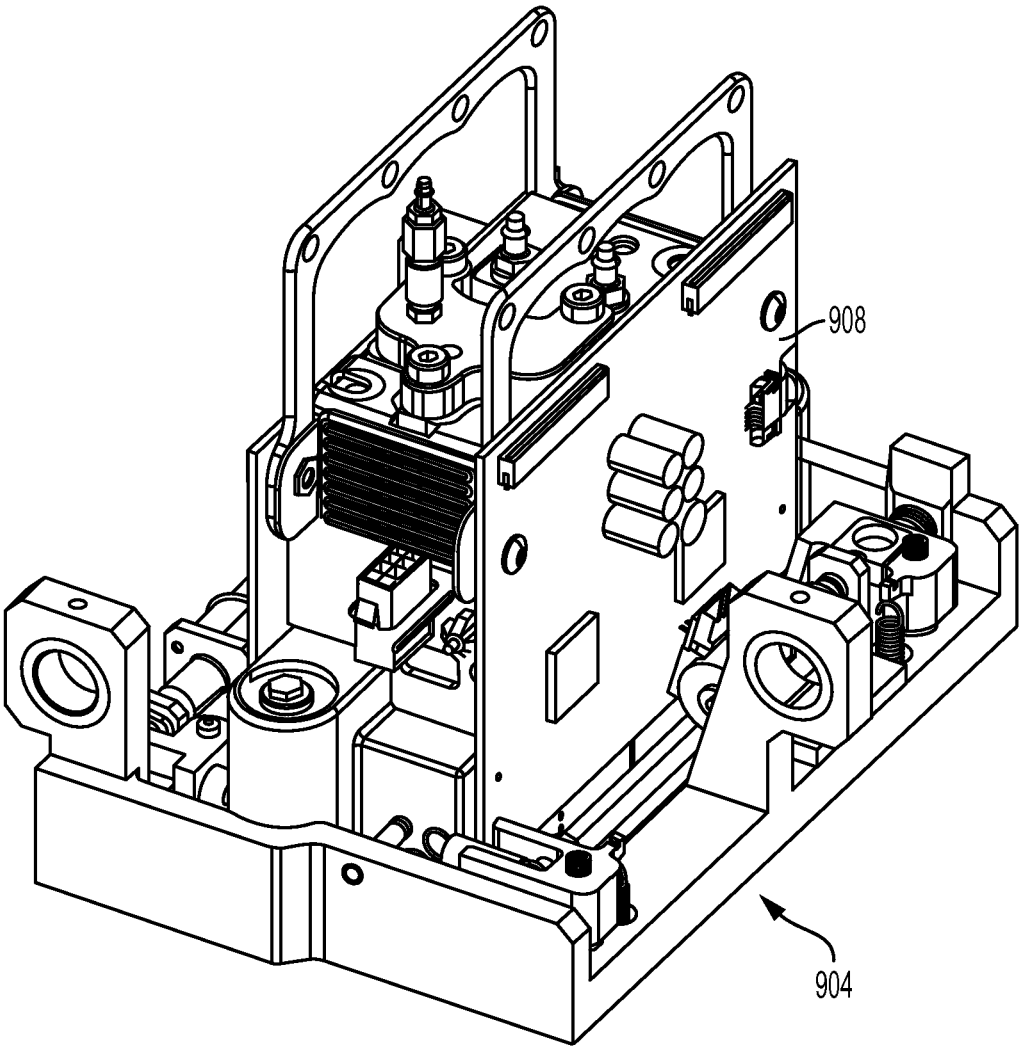
FIG. 10 PRIOR ART
FIG. 10 shows a prior art printhead assembly and printhead.

The maintenance module 400 further includes a seal 448 mounted to the body 404. An actuator is configured to move the seal 684 outward from the body 404 toward the surface 516 of the printhead 512 to press against the surface 516. As shown in FIG. 7, after the surface 516 has been wiped clean, the seal 448 presses the surface 516 to establish an air-tight seal around at least part of the surface 516. The seal established by the seal 448 prevents inkjets of the printhead 512 from drying out. FIG. 8 shows a perspective view of the maintenance module 400 with the seal 448 pressed against the printhead 512 to establish a seal around at least part of the surface 516 of the printhead 512.

It will be appreciated that variants of the above-disclosed and other features and functions, or alternatives thereof, may be desirably combined into many other different systems, applications or methods. Various presently unforeseen or unanticipated alternatives, modifications, variations, or improvements therein may be subsequently made by those skilled in the art, which are also intended to be encompassed by the following claims.

What is claimed is:

1. A maintenance cart for a printhead array comprising:

a body configured to selectively move along a path to the printhead array, the body having a recess;

a plurality of cleaning modules mounted within the recess, the plurality of cleaning modules being adjustably arranged within the recess to correspond to a plurality of printheads of the printhead array to enable each cleaning module in the plurality of cleaning modules to align with a corresponding printhead of the printhead array in response to the body being moved to the printhead array; and a first shaft arranged within the recess, a first group of the plurality of cleaning modules being mounted and adjustably arranged along the shaft to align with printheads in a first row of printheads of printhead array.

2. The cart of claim 1 further comprising:

a second shaft arranged within the recess, a second group of the plurality of cleaning modules being mounted and adjustably arranged along the shaft to align with printheads in a second row of printheads of printhead array.

3. The cart of claim 1, each cleaning module in the plurality of cleaning modules further comprising:

a member; and a wiper mounted on the member and configured to wipe against a surface of the printhead of the printhead array aligned with the cleaning module.

4. The cart of claim 3, each cleaning module of the plurality of cleaning modules further comprising:

an enclosure, the member being mounted within the enclosure and being configured to move independently from the enclosure to selectively move the wiper into contact with the printhead of the printhead array aligned with the cleaning module.

5. The cart of claim 3, each cleaning module of the plurality of cleaning modules further comprising:

an actuator configured to selectively move the member to bring the wiper into contact with the printhead of the printhead array aligned with the cleaning module.

6. The cart of claim 5, the actuator comprising:

a cam configured to rotate and selectively move the member to bring the wiper into contact with the printhead of the printhead array aligned with the cleaning module.

7. The cart of claim 3, each cleaning module of the plurality of cleaning modules further comprising:

a flexible material configured to wipe against the surface of the printhead of the printhead array aligned with the cleaning module after the wiper wipes against the surface of the printhead of the printhead array aligned with the cleaning module.

8. The cart of claim 7, each cleaning module of the plurality of cleaning modules further comprising:

a plurality of rollers, the flexible material being entrained about the plurality of rollers in a closed loop, the rollers being configured to rotate the wiping cloth about the closed loop.

9. The cart of claim 3, each cleaning module of the plurality of cleaning modules further comprising:

a tray positioned with reference to the wiper to receive debris from the printhead of the printhead array aligned with the cleaning module as the wiper wipes against the surface of the printhead of the printhead array aligned with the cleaning module.

10. The cart of claim 3, each cleaning module of the plurality of cleaning modules further comprising:

a seal configured to move toward the printhead of the printhead array aligned with the cleaning module after the wiper wipes against the surface of the surface of the printhead of the printhead array aligned with the cleaning module, the seal being configured to form a seal around at least part of the surface of the printhead of the printhead array aligned with the cleaning module.

11. A printer comprising:

a printhead array have a plurality of printheads that are arranged as a first row of printheads and a second row of printheads;

a track defining a path leading to and from the printhead array; and a maintenance cart configured to selectively move along the track to and from the printhead array to perform maintenance operations on the printhead array, the maintenance cart comprising:

a body having a recess;

a plurality of cleaning modules mounted within the recess, the plurality of cleaning modules being adjustably arranged within the recess to correspond to the plurality of printheads of the printhead array to enable each cleaning module in the plurality of cleaning modules to align with a corresponding printhead of the printhead array in response to the body being moved to the printhead array;

a first shaft arranged within the recess, a first group of the plurality of cleaning modules being mounted and adjustably arranged along the shaft to align with printheads in a first row of printheads of printhead array; and a second shaft arranged within the recess, a second group of the plurality of cleaning modules being mounted and adjustably arranged along the shaft to align with printheads in a second row of printheads of printhead array.

12. The printer of claim 11, each cleaning module in the plurality of cleaning modules further comprising:

a member; and a wiper mounted on the member and configured to wipe against a surface of the printhead of the printhead array aligned with the cleaning module.

13. The printer of claim 12, each cleaning module of the plurality of cleaning modules further comprising:

an enclosure, the member being mounted within the enclosure and being configured to move independently from the enclosure to selectively move the wiper into contact with the printhead of the printhead array aligned with the cleaning module.

14. The printer of claim 12, each cleaning module of the plurality of cleaning modules further comprising:

a cam configured to rotate and selectively move the member to bring the wiper into contact with the printhead of the printhead array aligned with the cleaning module.

15. The printer of claim 12, each cleaning module of the plurality of cleaning modules further comprising:

a flexible material configured to wipe against the surface of the printhead of the printhead array aligned with the cleaning module after the wiper wipes against the surface of the printhead of the printhead array aligned with the cleaning module.

16. The cart of claim 15, each cleaning module of the plurality of cleaning modules further comprising:

a plurality of rollers, the flexible material being entrained about the plurality of rollers in a closed loop, the rollers being configured to rotate the wiping cloth about the closed loop.

17. The printer of claim 12, each cleaning module of the plurality of cleaning modules further comprising:

a tray positioned with reference to the wiper to receive debris from the printhead of the printhead array aligned with the cleaning module as the wiper wipes against the surface of the printhead of the printhead array aligned with the cleaning module.

18. The printer of claim 12, each cleaning module of the plurality of cleaning modules further comprising:

a seal configured to move toward the printhead of the printhead array aligned with the cleaning module after the wiper wipes against the surface of the surface of the printhead of the printhead array aligned with the cleaning module, the seal being configured to form a seal around at least part of the surface of the printhead of the printhead array aligned with the cleaning module.

* * * * *